US006174206B1

(12) United States Patent
Yentile et al.

(10) Patent No.: US 6,174,206 B1
(45) Date of Patent: Jan. 16, 2001

(54) CONNECTOR ADAPTOR FOR BNC CONNECTORS

(75) Inventors: Thomas W. Yentile, Wilmington; Clifford G. Westland, Chelmsford, both of MA (US)

(73) Assignee: Avid Technology, Inc., Tewksbury, MA (US)

( * ) Notice: Under 35 U.S.C. 154(b), the term of this patent shall be extended for 0 days.

(21) Appl. No.: 09/345,983

(22) Filed: Jul. 1, 1999

(51) Int. Cl.[7] ..... H01R 25/00
(52) U.S. Cl. ..... 439/638; 439/578; 439/675
(58) Field of Search ..... 439/638, 675, 439/578, 585, 651

(56) References Cited

U.S. PATENT DOCUMENTS

| | | | | |
|---|---|---|---|---|
| 4,728,301 | * | 3/1988 | Hemmer et al. | 439/578 |
| 4,846,731 | * | 7/1989 | Alwine | 439/675 |
| 5,074,809 | * | 12/1991 | Rousseau | 439/578 |
| 5,387,116 | | 2/1995 | Wang | 439/188 |
| 5,474,470 | * | 12/1995 | Hammon, Jr. | 439/578 |
| 5,556,292 | * | 9/1996 | Kato et al. | 439/675 |
| 5,613,880 | | 3/1997 | Wang | 439/620 |
| 5,695,365 | | 12/1997 | Kennedy et al. | 439/638 |
| 5,790,896 | | 8/1998 | Nguyen | 439/49 |

FOREIGN PATENT DOCUMENTS

| | | |
|---|---|---|
| 39 10 514 | 10/1990 | (DE) . |
| 92 14 853 | 1/1993 | (DE) . |
| 42 29 705 A1 | 3/1994 | (DE) . |

OTHER PUBLICATIONS

Calrad Connector Catalog, p. 83, Model #75–567.

* cited by examiner

*Primary Examiner*—Paula Bradley
*Assistant Examiner*—Tho D. Ta
(74) *Attorney, Agent, or Firm*—Wolf, Greenfield & Sacks P.C.

(57) ABSTRACT

A quick-connect connector adaptor for use between male and female portions of a BNC connector includes a body having mating male and female portions. The male portion of the adaptor may be inserted into the female portion of the BNC connector without locking thereto, thereby allowing quick connection thereto. A plurality of these adaptors may be mounted to a panel for simultaneous quick-connection to a plurality of connector portions of BNC connectors disposed on an electrical instrument. In this manner, a plurality of connections may be quickly and accurately made.

17 Claims, 4 Drawing Sheets

CONNECTOR ADAPTOR FOR BNC CONNECTORS

BACKGROUND

Various connectors, such as BNC connectors, facilitate attachment of electrical cables to electrical instruments. In a typical BNC connection, a female portion of the connector is mounted to an electrical instrument and a male portion of the connector is connected to a cable. The female portion includes a tubular cylindrical housing and a socket formed in a central location of the housing. The male portion includes a tubular cylindrical housing having a pin formed in a central location of the housing. The pin of the male portion may connect into the socket of female portion and the housing of the male portion may be inserted into the housing of the female portion.

The female portion also includes outwardly radially extending posts formed on the outer surface of the housing and the male portion includes a locking sleeve, disposed around the outer surface of the housing of the male portion. The locking sleeve includes grooves to mate with the posts on the female portion. To lock the connector portions together, the grooves in the locking sleeve receive the posts. The locking sleeve is then rotated relative to the female portion so that the posts are held within the grooves, thereby securing the connection.

When making one connection, the task of insertion and twist-locking the connectors together is relatively straight forward. However, when multiple connections must be made, this task becomes rather tedious. For example, the connector installer must ascertain the specific interconnection of each cable with each input/output connection of the electrical instrument. This may result in an increase in the time necessary for each of the connections, as well as an increase in the likelihood that some of the connections may be incorrect.

This problem is compounded when multiple connections must be made repeatedly to a number of electrical instruments such as, for example, when testing multiple electrical instruments upon completion of assembly of each during manufacture of the instruments.

SUMMARY

In one aspect, an electrical connector adaptor includes a housing having first and second ends. A female portion is formed at the first end of the housing and is adapted for receiving a male portion of a BNC connector. A non-locking male portion is formed at the second end of the housing and is adapted for insertion into a female portion of the BNC connector without locking thereto.

In another aspect, a fixture for connection to a plurality of first connector portions disposed on an instrument includes a plurality of second non-locking connector portions shaped and sized to electrically mate with the first connector portions. The second non-locking connector portions are secured to the fixture in fixed relation to each other that correspond to the relation of the first connector portions to each other. The second non-locking connector portions are adapted for simultaneous engagement and disengagement with the first connector portions.

In another aspect, a method of testing a plurality of electrical instruments, each having a plurality of first connector portions disposed thereon, with a fixture is disclosed. The fixture has a plurality of second non-locking connector portions secured thereto. The second non-locking connector portions are secured to the fixture in a spaced relation with each other that corresponds to a spaced relation of the first connector portions. The second non-locking connector portions are electrically coupled to a test device. The method includes the steps, for each electrical instrument, of simultaneously engaging the second non-locking connector portions to the first connector portions, performing a predetermined test on the electrical instrument, and simultaneously disengaging the second non-locking connector portions from the first connector portions.

In another aspect, an electrical connector adaptor includes a generally cylindrical tubular housing having first and second ends. A female portion is formed at the first end of the housing and a non-locking male portion is formed at the second end of the housing. The non-locking male portion is adapted for insertion into a BNC female connector portion. A rigid conductive shaft having a first and second end extends between the non-locking male portion and the female portion. The shaft includes a socket disposed at the first end thereof and a pin at the second end thereof.

In another aspect, an electrical connector adaptor includes a central conductive shaft having first and second ends. The first end is formed with a socket and the second end is formed with a pin. An insulator surrounds at least a part of the central shaft and a housing surrounds the insulator. The housing includes a female portion and a non-locking, push-in male portion. The female portion surrounds the socket and the non-locking male portion surrounds at least a part of the pin.

In another aspect, an electrical connector adaptor includes a female portion having a conductive, substantially cylindrical tubular outer housing and a conductive, substantially tubular inner socket. The outer housing has a plurality of outwardly radially extending posts. The inner socket has at least one longitudinally extending slit. The adaptor also includes a non-locking, push-in male portion having a conductive, substantially tubular outer housing, an insulative, substantially tubular member disposed adjacent an inner surface of the tubular outer housing, and a conductive, substantially cylindrical inner pin centrally disposed within the insulative, substantially tubular member. The outer housing of the non-locking male portion has at least one longitudinally extending slit. The pin and the socket are formed as a unitary rigid shaft and the outer housing of the non-locking male portion and the outer housing of the female portion is formed as a unitary rigid body.

Another aspect is an electrical connector adaptor including a generally cylindrical tubular non-locking male portion having at least one spring finger biased radially outward. The at least one spring finger is the radially outermost portion of the non-locking male end.

In another aspect, a method of making a fixture is disclosed. The method includes the steps of providing a panel having a plurality of electrical connector adaptors for coupling to a plurality of female portions of BNC connectors arranged on an instrument. The connector adaptors each having a non-locking male portion formed at one end thereof and adapted for insertion into a female portion of the BNC connector without locking thereto. The method also includes the step of arranging the adaptors relative to the panel in a relationship that corresponds to a relationship of the female portions of the BNC connectors on the instrument.

Various embodiments provide certain advantages and overcome certain drawbacks of the conventional techniques. Not all embodiments share the same advantages and those that do may not share them under all circumstances. Further features and advantages as well as the structure and operation of various embodiments are described in detail below with reference to the accompanying drawings.

DETAILED DESCRIPTION

A quick-connect connector adaptor includes a body having a non-locking male portion and female portion. The non-locking male portion may be adapted to be inserted into a female portion of a BNC connector without locking thereto. Thus, quick connection between the non-locking male portion and the female portion of the BNC connector may be made.

According to another aspect, a plurality of these adaptors are mounted to a panel for simultaneous quick-connection to a plurality of connector portions of BNC connectors disposed on an electrical instrument. In this manner, a plurality of connections may be quickly and accurately made.

Figure 1:
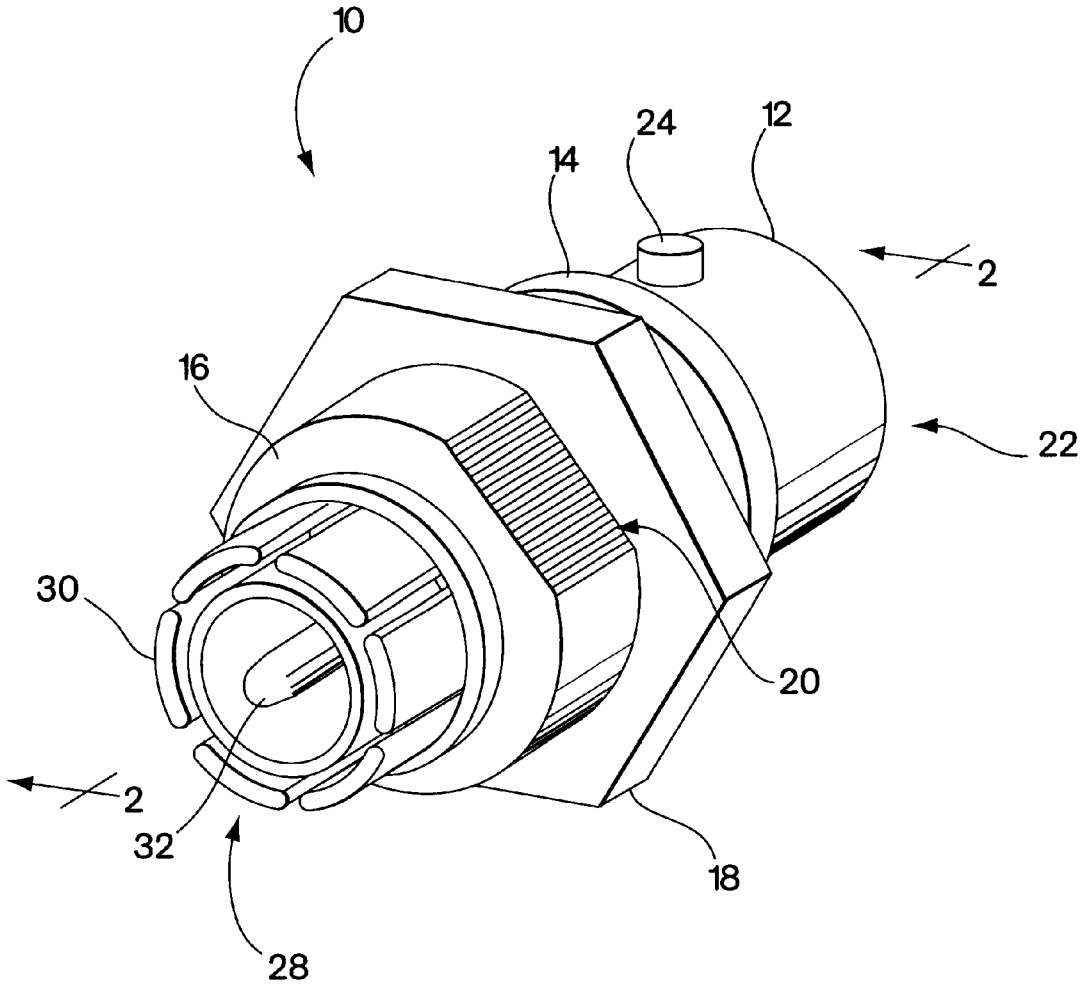
FIG. 1 is a perspective view of an adaptor.
Figure 2:
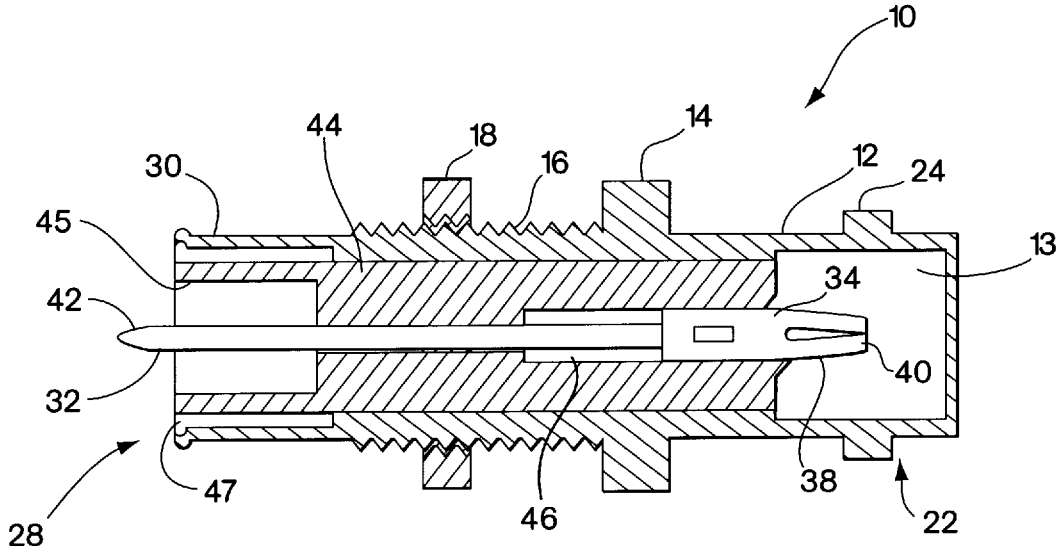
FIG. 2 is a cross-sectional view of the adaptor taken along line 2—2 of FIG. 1.

Referring now to FIG. 1, which is a perspective view of an adaptor, and FIG. 2, which is a cross-sectional view of the adaptor taken along line 2—2 of FIG. 1, in an illustrative embodiment, a quick-connect adaptor 10 provides connection between male and female portions of a BNC connector. The adaptor 10 includes a cylindrical tubular housing 12, preferably formed of a conductive material, such as metal, having a longitudinally extending hole 13 extending therethrough. The housing may be formed as a unitary structure. The cylindrical housing 12 may also include a mounting boss 14 formed on outer circumference and a threaded section 16 formed adjacent to the mounting boss 14. A nut 18 may be used to secure the adaptor 10, for example, to a panel, as will be described hereinafter.

The outer surface of the threaded section 16 may be formed with a desired shape that corresponds to a shaped hole formed in the panel. In this manner, orientation of the adaptor relative to the panel is provided. For example, in one embodiment, a flat section 20 is formed on the threaded section 16 such that the cross-section of the adaptor resembles a "D" shape. A corresponding "D" shaped hole may then be provided in the panel. The shaped hole may also be useful in holding the adaptor as the nut 18 is secured thereto. In addition, or in the alternative, to facilitate attachment of the adaptor 10 to the panel, the boss 14 may be provided with an installation tool surface, such as flats, which may be in the form of a square or hex, to facilitate engagement with a wrench. The installation tool surface may be helpful in holding the adaptor as the nut is tightened thereto, especially if the panel includes a round-shaped hole to receive the adaptor. Alternatively, the installation tool surface may be formed as any suitable surface in any suitable location on the housing 12.

The housing 12 may further include a female connector portion 22 formed at one end of the housing 12 and includes radially extending posts 24 formed on the outer surface of the housing. The female portion 22 is adapted to receive a male portion of the BNC connector. The housing 12 also includes a non-locking, push-in male connector portion 28 formed at another end of the housing 12. The outer cylindrical surface of the male portion 28 may be formed with one or more longitudinally extending slits to define one or more spring fingers 30, which act to bias the male portion 28 into engagement within a corresponding female portion of the BNC connector. The spring fingers 30 are the radially outermost portion of the non-locking, push-in male portion 28. According to one aspect, the male portion 28 is non-locking. In this manner, quick connection into a female portion of the BNC connector may be readily performed.

A central conductive shaft 32 may pass through the housing 12 from the female portion 22 to the male portion 28. The shaft 32 may be formed as a rigid member and may be formed as a hollow or solid shaft. The shaft may have any shape, for example, cylindrical. The shaft may also be formed as a multi-component structure or as a unitary structure. A socket 34 may be formed on the shaft 32 of the female portion 22. The socket 34 may be soldered or crimped onto the shaft 32 or may be integrally formed therewith. The socket 34 may be formed as a hollow cylindrical conductive body 38 having one or more longitudinally extending slits to define one or more split ends 40 which radially expand when receiving a mating pin from the male portion of the BNC connector. The shaft 32 may further include a pin 42 formed thereon to form part of the male portion 28. The pin 42 may be adapted for insertion into a socket of a female portion of a BNC connector. The socket 34 and pin 42 may be gold-plated to enhance conductivity. The entire shaft 32 may be gold plated.

The adaptor 10 may further include a substantially cylindrical tubular insulator 44 formed of a dielectric material disposed within the housing 12 adjacent the inner surface of the housing, such that the housing surrounds the insulator. The insulator may have a length less than that of the housing and disposed within the housing so as not to extend into the female portion 22, as shown in FIG. 2. To affix the insulator within the housing, the insulator 44 may be press-fit into the hole 13. Other methods, such as gluing, staking, crimping or threading may be used to secure the insulator 44 in the hole 13. Also, the insulator may be injection molded directly into the hole 13.

The adaptor may further include an internal support 45 disposed radially inward of the spring fingers 30. The internal support 45 prevents radial inward deflection of the spring fingers 30 beyond a predetermined amount. In one illustrative embodiment, part of the insulator 44 may extend into the male portion 28 to form the internal support 45. The spacing 47 between the internal support 45 and the housing 12 may be sized based on the amount of desired radial inward deflection of the spring fingers 30.

A hole 46 of the tubular insulator receives the shaft 32 such that the insulator surrounds at least part of the shaft 32. The shaft 32 may be secured in the hole of the insulator using any suitable method, such as, for example, press-fitting, gluing, staking, crimping or threading.

The impedance of the adaptor may be determined based on the characteristics of the insulator 44. For example, a particular dielectric material selected for the insulator 44 may provide an adaptor having one impedance, such as 50 Ω, whereas a different dielectric material selected may provide an adaptor having another impedance, such as 75 Ω. Other impedance values may also be provided. Alternatively, or in addition, the impedance may be determined by the physical dimensions of the insulator relative to the adaptor shaft 32. Thus, a change in the size of the hole 46 relative to the shaft 32 results in a change in impedance.

Figure 3:
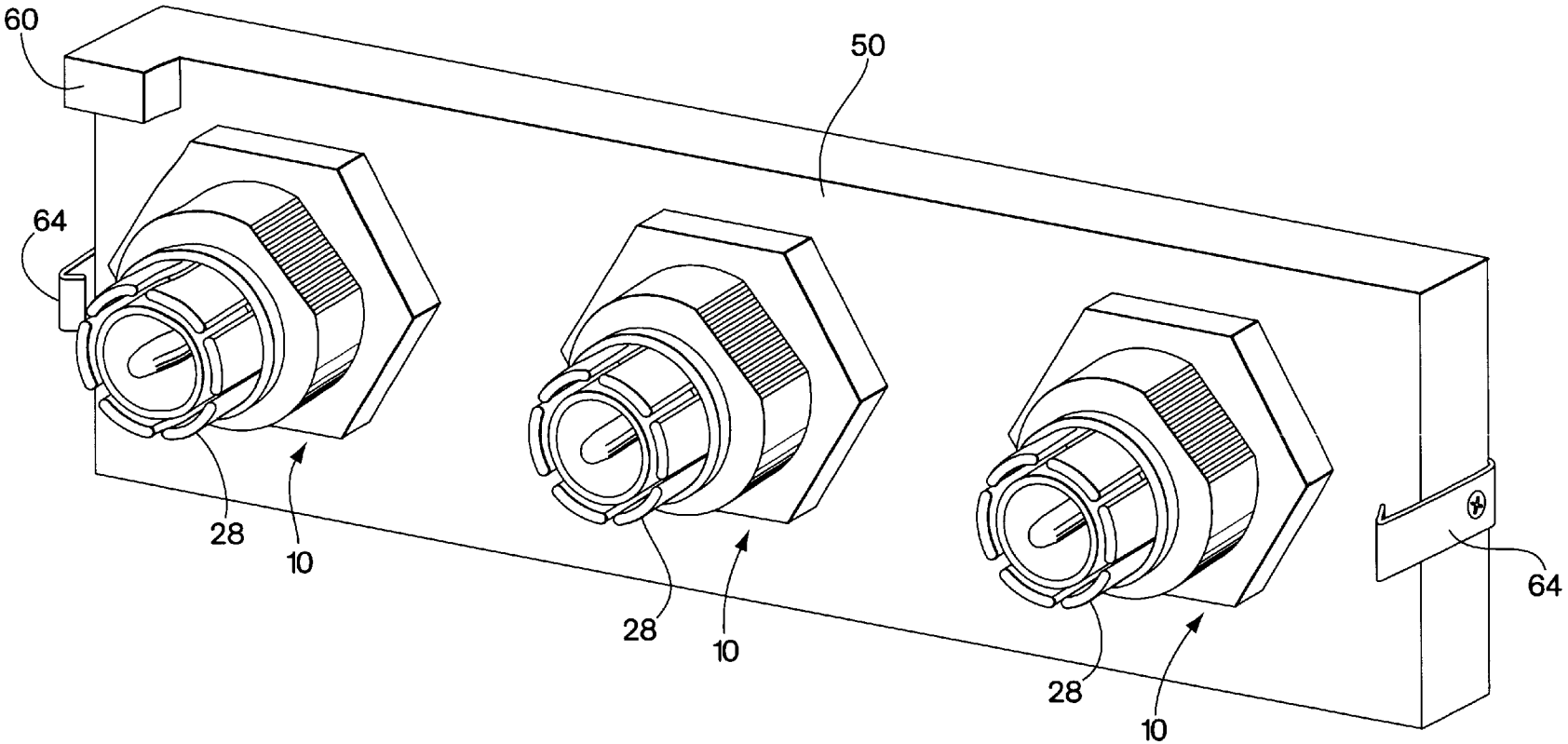
FIG. 3 is a perspective view showing a plurality of adaptors of FIG. 1 mounted to a panel; and, FIG. 4 is a perspective view of the panel mounted adaptors of FIG. 3 shown connecting with a mating electrical instrument.
Figure 4:
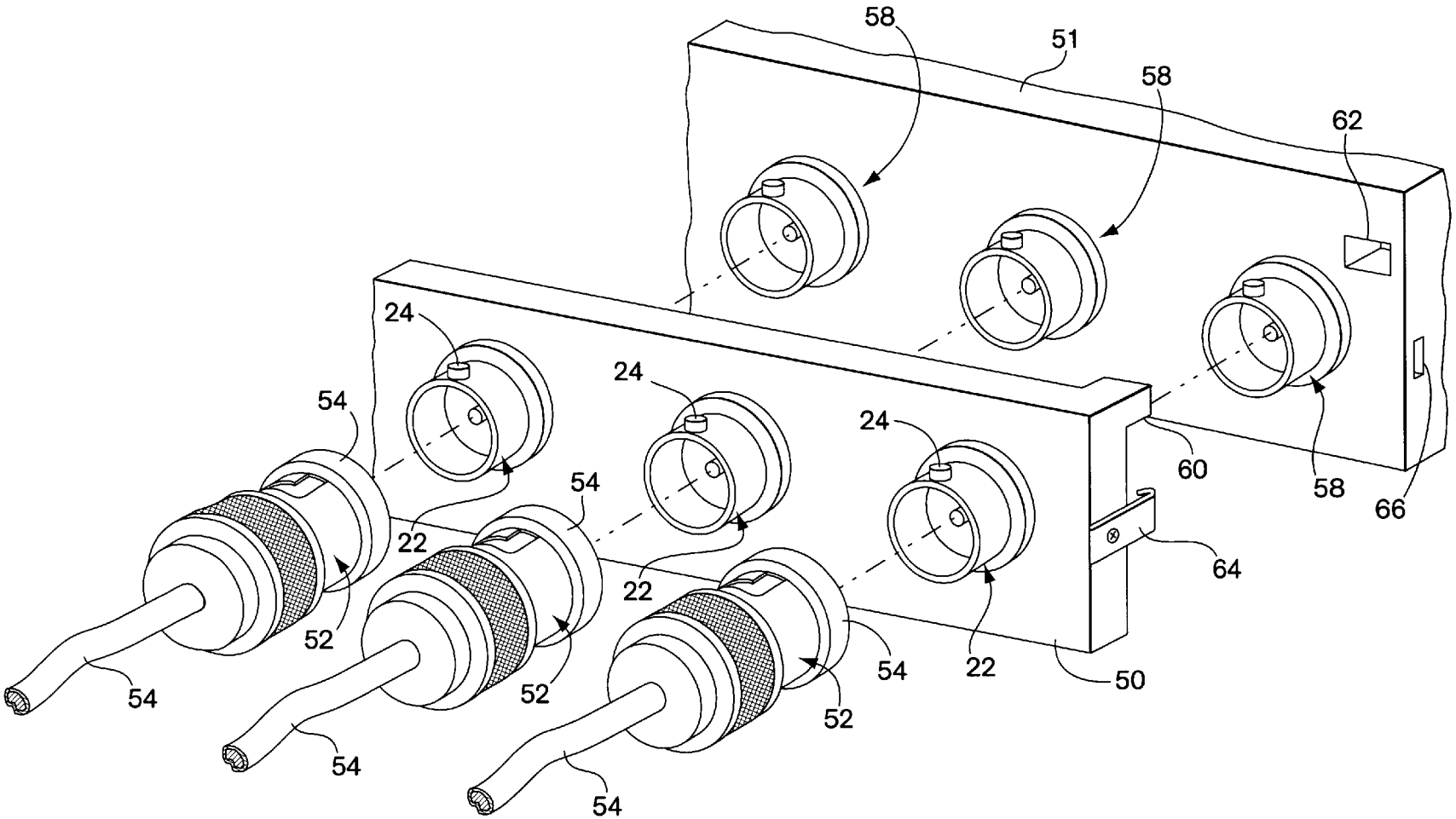

Referring now to FIG. 3, which is a perspective view showing a front view of a plurality of adaptors of FIG. 1 mounted to a panel, and FIG. 4, which is a perspective view of a rear view of the panel-mounted adaptors, in an illustrative embodiment, a plurality of adaptors 10 may be mounted in a predetermined arrangement on a panel 50 for quick connection to a corresponding arrangement of connector portions disposed on an electrical instrument 51. An example electrical instrument is a break-out box for audio and video processing. Such a device includes analog to digital and digital to analog converters for video and audio signals.

As shown in FIG. 4, the female portions 22 of the panel mounted adaptors 10 may be adapted to receive male portions 52 of BNC connectors coupled to cables 54. Each male portion 52 includes a locking sleeve 54 adapted to connect with the posts 24 on each female end 22 of the adaptor 10. The cables 54, and thus the adaptors 10, may be attached to another electrical instrument (not shown) adapted to send and receive signals to and from the electrical instrument 51. For example, the cables 54, and thus the adaptors 10, may be connected to a test instrument which may be used to test the integrity of many electrical instruments, such as, for example, at the end of an assembly line during manufacture of the electrical instrument. In this manner, the male portions 52 of the BNC connectors may be individually attached and locked to the adaptors 10 in the precise order desired rather than individually attaching and locking the individual male portions 52 of the BNC connectors directly to the female portions 58 on the electrical instrument 51. Thus, when repeatedly connecting to numerous electrical instruments, the possibility of misconnections is reduced.

The adaptors 10 may now simultaneously engage with the electrical instrument 51 by plugging the non-locking male portions 28 (not shown in the rear view of the panel 50 in FIG. 4) into the female portions 58 of the BNC connectors on the electrical instrument 51 without individually locking the male portions 28 to the female portions 58 of the BNC connectors on the electrical instrument 51. A test then may be performed on the electrical instrument 51. Upon completion of the test, the test instrument may be disengaged from the electrical instrument 51 by simultaneously unplugging the plurality of adaptors 10 from the female portions 58 of the BNC connectors on the electrical instrument 51.

Although this aspect is described in detail in conjunction with a test device and test a sequence, the panel mounted adaptors 10 also may be used to simultaneously engage and simultaneously disengage a plurality of cables 54 or any device or instrument having a plurality of connector portions to any other device having another plurality of connectors portions.

According to another aspect, the panel-mounted adaptors may be arranged on the panel in a manner such that the adaptors may be connected to the electrical instrument in only one orientation. This may be accomplished, for example, by altering the spacing between adaptors. Alternatively, the panel itself may be adapted to connect to the electrical instrument in only one orientation by, for example, providing any suitable orientation feature such as an orienting boss 60 and receiving hole 62. Thus, the possibility of misconnection between a particular cable and a particular connector portion on the electrical instrument may be reduced.

Continuing with reference to FIGS. 3 and 4, according to another aspect, the panel may be provided with a suitable locking feature to removably lock the panel to the electrical instrument 51. For example, the panel 50 may be provided with a clip 64 to secure the panel 50 to the electrical instrument 51. The electrical instrument 51 also may include a clip receiving portion 66, such as a groove, for receiving the clip 60. Alternatively, the panel may be removably locked to the electrical instrument using threaded fasteners, cam-lock fasteners, hooks, push-on plug-like fasteners, latches or ball detent devices, to name a few.

Having now described a few embodiments, it should be apparent to those skilled in the art that the foregoing is merely illustrative and not limiting, having been presented by way of example only. Numerous modifications and other embodiments are within the scope of one of ordinary skill in the art and are contemplated as falling within the scope of the invention.

What is claimed is:

1. An electrical connector adaptor comprising:

a generally cylindrical tubular housing having first and second ends;

a female portion formed at said first end of said housing, said female portion having a pair of radially outwardly extending posts formed on the outer surface of said housing at said first end, said posts being adapted for receiving a locking portion of a BNC male connector portion;

a non-locking male connector portion formed at said second end of said housing, said non-locking male portion being adapted for insertion into a BNC female connector portion without locking thereto; and, a rigid conductive shaft having first and second ends extending between said non-locking male portion and said female portion.

2. An adaptor according to claim 1 wherein said first end of said shaft is located proximate to said first end of said housing, said first end of said shaft having a socket disposed thereon.

3. An adaptor according to claim 1 wherein said second end of said shaft is located proximate to said second end of said housing, said second end of said shaft being formed with a pin.

4. An adaptor according to claim 1 wherein said housing is adapted for mounting to a panel.

5. An adaptor according to claim 4 in combination with the panel.

6. A combination according to claim 5 wherein said panel comprises a plurality of said adaptors mounted thereto for connection to a plurality of BNC female connector portions disposed on an instrument, said plurality of non-locking male connector portions each being shaped and sized to electrically mate with a corresponding one of the plurality of BNC female connector portions disposed on the instrument, said non-locking male connector portions being secured to said panel in fixed relation to each other that corresponds to the relation of the BNC female connector portions to each other, said non-locking male connector portions being adapted for simultaneous engagement and disengagement with BNC female connector portions.

7. A combination according to claim 6 wherein said non-locking male connector portions are arranged relative to said panel such that said non-locking male connector portions are adapted for engagement with the BNC female connector portions in only one orientation.

8. A combination according to claim 6 wherein said panel is adapted for engagement with the instrument in only one orientation.

9. A combination according to claim 6 wherein said panel is adapted for removably locking to the instrument.

10. An adaptor according to claim 1 wherein said non-locking male portion includes a plurality of spring fingers biased radially outward, with said spring fingers being the radially outermost portion of said non-locking male portion.

11. An adaptor according to claim 10 further comprising an internal support disposed radially inward of said spring fingers to prevent radial inward deflection of said spring fingers beyond a predetermined amount.

12. An electrical connector adaptor comprising:

a central conductive shaft having first and second ends, said first end being formed with a socket, said second end being formed with a pin;

an insulator surrounding at least a part of said central shaft; and, a housing surrounding said insulator, said housing having a female portion, said female portion having a plurality of outwardly radially extending posts, said posts being adapted for receiving a locking portion of a BNC male connector portion, said housing further having a non-locking, push-in male portion, said female portion surrounding said socket, said male portion surrounding at least a part of said pin.

13. An adaptor according to claim 12 wherein said non-locking, push-in male portion of said housing includes a plurality of spring fingers biased radially outward, with said spring fingers being the radially outermost portion of said housing at said non-locking male portion.

14. An adaptor according to claim 13 further comprising an internal support disposed radially inward of said spring fingers to prevent radial inward deflection of said spring fingers beyond a predetermined amount.

15. An electrical connector adaptor comprising:

a female portion having a conductive, substantially cylindrical tubular outer housing and a conductive, substantially tubular inner socket, said outer housing of said female portion having a plurality of outwardly radially extending posts, said posts being adapted for receiving a locking portion of a BNC male connector portion, said inner socket having at least one longitudinally extending slit; and, a non-locking, push-in male portion having a conductive, substantially tubular outer housing, an insulative, substantially tubular member disposed adjacent an inner surface of said tubular outer housing, and a conductive, substantially cylindrical inner pin centrally disposed within said insulative, substantially tubular member, said outer housing of said male portion having at least one longitudinally extending slit, with said pin and said socket being formed as a unitary rigid shaft, with said outer housing of said male portion and said outer housing of said female portion being formed as a unitary rigid body.

16. An adaptor according to claim 15 wherein said at least one longitudinally extending slit formed in said outer housing of said non-locking, push-in male portion defines at least one spring finger, with said spring finger being the radially outermost portion of said housing at said non-locking male portion.

17. An adaptor according to claim 16 further comprising an internal support disposed radially inward of said spring fingers to prevent radial inward deflection of said spring fingers beyond a predetermined amount.

* * * * *